US007488915B2

(12) United States Patent
Pollitt et al.

(10) Patent No.: US 7,488,915 B2
(45) Date of Patent: Feb. 10, 2009

(54) ARC BAFFLE, AND ARC CHUTE ASSEMBLY AND ELECTRICAL SWITCHING APPARATUS EMPLOYING THE SAME

(75) Inventors: William C. Pollitt, Murrysville, PA (US); John J. Shea, Pittsburgh, PA (US); Aaron T. Kozar, Zelienople, PA (US); Nathan J. Weister, Darlington, PA (US)

(73) Assignee: Eaton Corporation, Cleveland, OH (US)

( * ) Notice: Subject to any disclaimer, the term of this patent is extended or adjusted under 35 U.S.C. 154(b) by 175 days.

(21) Appl. No.: 11/533,655

(22) Filed: Sep. 20, 2006

(65) Prior Publication Data

US 2008/0067153 A1 Mar. 20, 2008

(51) Int. Cl.
*H01H 33/02* (2006.01)

(52) U.S. Cl. ..... 218/149; 218/34; 218/157; 335/201

(58) Field of Classification Search ..... 218/7, 218/14, 15, 34–41, 147–149, 151, 154–157; 335/16, 147, 201
See application file for complete search history.

(56) References Cited

U.S. PATENT DOCUMENTS 3,448,231 A * 6/1969 Heft ..... 218/89
3,997,746 A 12/1976 Harper et al.
4,019,005 A * 4/1977 Michetti ..... 218/149
5,861,596 A 1/1999 Grass et al.
6,222,147 B1 4/2001 Doughty et al.
6,248,971 B1 * 6/2001 Morel et al. ..... 218/157
7,034,242 B1 4/2006 Shea et al.
2002/0139741 A1 * 10/2002 Kopf ..... 210/224
2003/0048586 A1 3/2003 Faber et al.

FOREIGN PATENT DOCUMENTS

DE 44 10 108 A1 3/1994
DE 101 49 019 C1 9/2001

OTHER PUBLICATIONS

Written Opinion issued in International Application No. PCT/IB2007/002715.

* cited by examiner

*Primary Examiner*—Elvin G Enad
*Assistant Examiner*—Marina Fishman
(74) *Attorney, Agent, or Firm*—Charles E. Kosinski

(57) ABSTRACT

An arc baffle for an arc chute assembly of a circuit breaker includes a first baffle member disposed at or about the second end of the arc chute assembly and including a plurality of first venting holes, a second baffle member including a plurality of second venting holes and being coupled to and disposed opposite from the first baffle member, and a filter assembly disposed at or about the second baffle member and including a number of filter elements. The first and second venting holes of the first and second baffle members are offset to induce turbulent flow of ionized gases being discharged from the arc chute assembly. The filter elements of the filter assembly filter the turbulent flow. An arc chute assembly and an electrical switching apparatus are also disclosed.

28 Claims, 7 Drawing Sheets

ARC BAFFLE, AND ARC CHUTE ASSEMBLY AND ELECTRICAL SWITCHING APPARATUS EMPLOYING THE SAME

CROSS-REFERENCE TO RELATED APPLICATIONS

U.S. patent application Ser. No. 11/553,670, filed Sep. 20, 2006, entitled "ARC PLATE, AND ARC CHUTE ASSEMBLY AND ELECTRICAL SWITCHING APPARATUS EMPLOYING THE SAME"; and U.S. patent application Ser. No. 11/533,646, filed Sep. 20, 2006 entitled "GASSING INSULATOR, AND ARC CHUTE ASSEMBLY AND ELECTRICAL SWITCHING APPARATUS EMPLOYING THE SAME", which are hereby incorporated herein by reference.

BACKGROUND OF THE INVENTION

1. Field of the Invention

The invention relates generally to electrical switching apparatus and, more particularly, to arc baffles for the arc chute assemblies of electrical switching apparatus, such as circuit breakers. The invention also relates to arc chute assemblies for electrical switching apparatus. The invention further relates to electrical switching apparatus employing arc chute assemblies.

2. Background Information

Electrical switching apparatus, such as circuit breakers, provide protection for electrical systems from electrical fault conditions such as, for example, current overloads, short circuits, and abnormal level voltage conditions.

Circuit breakers, for example, typically include a set of stationary electrical contacts and a set of movable electrical contacts. The stationary and movable electrical contacts are in physical and electrical contact with one another when it is desired that the circuit breaker energize a power circuit. When it is desired to interrupt the power circuit, the movable contacts and stationary contacts are separated. Upon initial separation of the movable contacts away from the stationary contacts, an electrical arc is formed in the space between the contacts. The arc provides a means for smoothly transitioning from a closed circuit to an open circuit, but produces a number of challenges to the circuit breaker designer. Among them is the fact that the arc results in the undesirable flow of electrical current through the circuit breaker to the load. Additionally, the arc, which extends between the contacts, often results in vaporization or sublimation of the contact material itself. Therefore, it is desirable to extinguish any such arcs as soon as possible upon their propagation.

To facilitate this process, circuit breakers typically include arc chute assemblies which are structured to attract and break-up the arcs. Specifically, the movable contacts of the circuit breaker are mounted on arms that are contained in a pivoting assembly which pivots the movable contacts past or through arc chutes as they move into and out of electrical contact with the stationary contacts. Each arc chute includes a plurality of spaced apart arc plates mounted in a wrapper. As the movable contact is moved away from the stationary contact, the movable contact moves past the ends of the arc plates, with the arc being magnetically drawn toward and between the arc plates. The arc plates are electrically insulated from one another such that the arc is broken-up and extinguished by the arc plates. Examples of arc chutes are disclosed in U.S. Pat. Nos. 7,034,242; 6,703,576; and 6,297,465.

Additionally, along with the generation of the arc itself, ionized gases, which can cause excessive heat and additional arcing and, therefore, are harmful to electrical components, are formed as a byproduct of the arcing event. It is desirable to release such ionized gases in a safe manner which aids in the interruption of the electrical circuit. This involves cooling and de-ionizing the gases. To this end, it has been known to attempt to control the venting of the ionized gas by employing a filter or baffle structure at or about the arc chute, such as a screen, a labyrinth of protrusions or obstacles arranged to provide a predetermined gas passageway therethrough, and/or a baffle structure wherein one or more apertures of the structure is (are) variable or adjustable in size to control the flow rate of the ionized gases. However, there remains a very real and recognizable need for an improved mechanism for controlling and dissipating the ionized gases.

Accordingly, there is room for improvement in arc baffles for the arc chute assemblies, and in arc chute assemblies for electrical switching apparatus.

SUMMARY OF THE INVENTION

These needs and others are met by embodiments of the invention, which are directed to arc baffles and arc chute assemblies for electrical switching apparatus wherein the arc baffles provide controlled arc chute venting.

As one aspect of the invention, an arc baffle is provided for an electrical switching apparatus. The electrical switching apparatus includes a housing, separable contacts enclosed by the housing, and at least one arc chute assembly. Each arc chute assembly has a first end disposed proximate the separable contacts in order to attract an arc generated by the separable contacts being opened, and a second end disposed distal from the first end for discharging ionized gases produced as a byproduct of the arc. The arc baffle comprises: a number of baffle members, each of the baffle members including a discharge portion having at least one opening for discharging the ionized gas; and a plurality of fasteners structured to couple the arc baffle and the baffle members to the arc chute assembly at or about the second end of the arc chute assembly.

The baffle members may comprise at least a baffle mount, wherein the discharge portion of the baffle mount comprises a generally planar member including the at least one opening. The baffle members of the arc baffle may also include at least a first baffle member structured to be disposed at or about the second end of the arc chute assembly and including a plurality of first venting holes, and a second baffle member including a plurality of second venting holes and being coupled to and disposed opposite from the first baffle member, wherein the first venting holes of the first baffle member are offset with respect to the second venting holes of the second baffle member and are structured to induce turbulent flow of the ionized gases being discharged from the second end of the arc chute assembly, and wherein the first baffle member and the second baffle member are substantially the same.

As another aspect of the invention, an arc baffle is provided for an electrical switching apparatus including a housing, separable contacts enclosed by the housing, and at least one arc chute assembly. Each arc chute assembly has a first end and a second end, the first end being disposed proximate the separable contacts in order to attract an arc generated by the separable contacts being opened, the second end being disposed distal from the first end for discharging ionized gases produced as a byproduct of the arc. The arc baffle comprises: a number of baffle members, each of the baffle members including a discharge portion having at least one opening for discharging the ionized gas; and a filter assembly disposed at or about the baffle members and including a number of filter elements. The one opening(s) of the baffle members is(are) structured to induce turbulent flow of the ionized gases being discharged from the second end of the at least one arc chute assembly, and the filter elements of the filter assembly filter the turbulent flow.

The filter assembly may be structured to permit the ionized gases to flow therethrough. The filter elements of the filter assembly may comprise a plurality of mesh members, wherein each of the mesh members has a plurality of apertures, and wherein the mesh members are layered in order to control the flow of the ionized gases through the apertures.

As a further aspect of the invention, an arc chute assembly is provided for an electrical switching apparatus including a housing and a pair of separable contacts enclosed by the housing, the separable contacts being structured to trip open, with an arc and ionized gases being generated in response to the separable contacts tripping open. The arc chute assembly comprises: first and second opposing sidewalls; a plurality of arc plates disposed between the first and second opposing sidewalls, the arc plates having first ends structured to be disposed proximate the separable contacts in order to attract the arc, and second ends disposed distal from the first ends for discharging the ionized gases; and an arc baffle comprising: a first baffle member disposed at or about the second ends of the arc plates of the arc chute assembly and including a plurality of first venting holes, a second baffle member including a plurality of second venting holes and being coupled to and disposed opposite from the first baffle member, and a filter assembly disposed at or about the second baffle member and including a number of filter elements, and a baffle mount securing the arc baffle to the arc chute assembly, wherein the first venting holes of the first baffle member are offset with respect to the second venting holes of the second baffle member and are structured to induce turbulent flow of the ionized gases being discharged from the second end of the arc chute assembly, and wherein the filter elements of the filter assembly filter the turbulent flow.

The baffle mount may comprise a generally planar member including an opening for discharging the ionized gases and a fastening mechanism for coupling the baffle mount and the arc baffle to the arc chute assembly. The first and second opposing sidewalls of the arc chute assembly may each include a plurality of openings, wherein the fastening mechanism of the baffle mount comprises a plurality of tabs, wherein each of the tabs of the baffle mount is disposed within a corresponding one of the openings of the first and second sidewalls in order to couple the baffle mount and the arc baffle to the arc chute assembly at or about the second ends of the arc plates thereof, and wherein when the baffle mount is coupled to the arc chute assembly, the filter assembly is disposed between the baffle mount and the second baffle member in order that a portion of at least one of the filter elements of the filter assembly is disposed in the opening of the generally planar member of the baffle mount, and the first baffle member and the second baffle member are disposed between the filter assembly and the second ends of the arc plates of the arc chute assembly.

As another aspect of the invention, an electrical switching apparatus comprises: a housing; separable contacts enclosed by the housing; an operating mechanism structured to open and close the separable contacts and to trip open the separable contacts in response to an electrical fault; and at least one arc chute assembly disposed at or about the separable contacts in order to attract and dissipate an arc which is generated by the separable contacts tripping open in response to the electrical fault and to discharge ionized gases produced as a byproduct of the arc, the at least one arc chute assembly comprising: first and second opposing sidewalls, a plurality of arc plates disposed between the first and second opposing sidewalls, the arc plates having first ends disposed proximate the separable contacts in order to attract the arc, and second ends disposed distal from the first ends for discharging the ionized gases, and at least one arc baffle comprising: a first baffle member disposed at or about the second ends of the arc plates of a corresponding one of the at least one arc chute assembly, and including a plurality of first venting holes, a second baffle member including a plurality of second venting holes and being coupled to and disposed opposite from the first baffle member, a filter assembly disposed at or about the second baffle member and including a number of filter elements, and a baffle mount securing the at least one arc baffle to the corresponding one of the at least one arc chute assembly, wherein the first venting holes of the first baffle member are offset with respect to the second venting holes of the second baffle member and are structured to induce turbulent flow of the ionized gases being discharged from the second end of the arc chute assembly, thereby cooling the ionized gases, and wherein the filter elements of the filter assembly filter the turbulent flow, thereby further cooling the ionized gases.

The electrical switching apparatus may be a circuit breaker having a plurality of poles and a housing, wherein the at least one arc chute assembly comprises a plurality of arc chute assemblies for the poles of the circuit breaker, and wherein the at least one arc baffle comprises a plurality of arc baffles for discharging the ionized gases from the arc chute assemblies of the circuit breaker. The housing of the circuit breaker may include a plurality of exhaust openings proximate the arc chute assemblies, wherein the arc baffles are disposed at or about the exhaust openings, and wherein the baffle mount for each of the arc baffles includes a plurality of fasteners for securing each of the arc baffles at or about a corresponding one of the exhaust openings of the housing of the circuit breaker.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
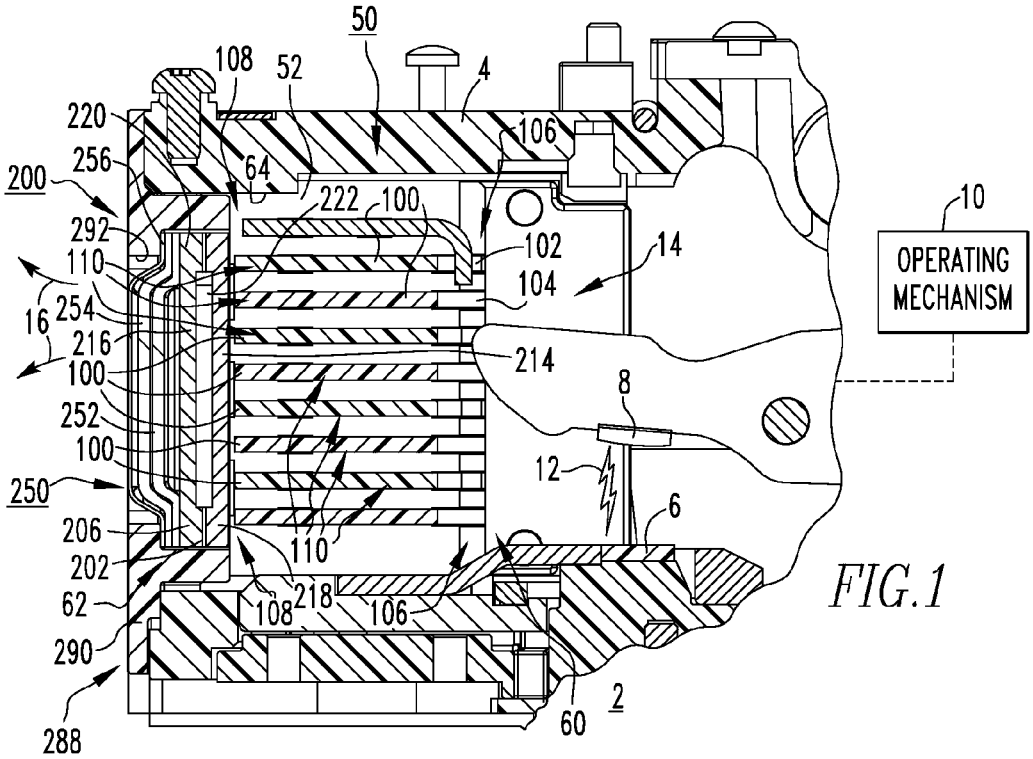
FIG. 1 is a cross-sectional view of a portion of a circuit breaker, including an arc chute assembly having arc plates and arc baffles therefor, in accordance with an embodiment of the invention.

For purposes of illustration, embodiments of the invention will be described as applied to arc chute assemblies for molded case circuit breakers, although it will become apparent that they could also be applied to a wide variety of electrical switching apparatus (e.g., without limitation, circuit switching devices and other circuit interrupters, such as contactors, motor starters, motor controllers and other load controllers) having an arc chute.

Directional phrases used herein, such as, for example, left, right, top, bottom, front, back and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

As employed herein, the term "ionized" means completely or partially converted into ions and being at least somewhat electrically conductive such as, for example, ionized gases generated by arcing between separable electrical contacts of a circuit breaker when opened.

As employed herein, the term "number" shall mean one or an integer greater than one (i.e., a plurality).

As employed herein, the term "offset" means out of alignment with respect to a predetermined reference point such as, for example and without limitation, an axis. For example, in accordance with an embodiment of the invention, the first venting holes of a first baffle member are offset with respect to the second venting holes of a second baffle member such that the axes of the first venting holes do not align with the axes of the second venting holes when the first and second baffle members are coupled together.

FIG. 1 shows a portion of an electrical switching apparatus, such as a circuit breaker 2, including a housing 4, separable contacts 6,8 (e.g., stationary contact 6 and movable contact 8), enclosed by the housing 4, and an operating mechanism 10 (shown in simplified form in FIG. 1) structured to open and close the separable contacts 6,8. Specifically, the operating mechanism 10 is structured to trip open the separable contacts 6,8 in response to an electrical fault (e.g., without limitation, an overcurrent condition, an overload condition, an undervoltage condition, or a relatively high level short circuit or fault condition). When the separable contacts 6,8 trip open, an arc 12 is generated as shown in FIG. 1. The circuit breaker 2 includes at least one arc chute assembly 50 disposed at or about the separable contacts 6,8 in order to attract and dissipate the arc 12.

Figure 2:
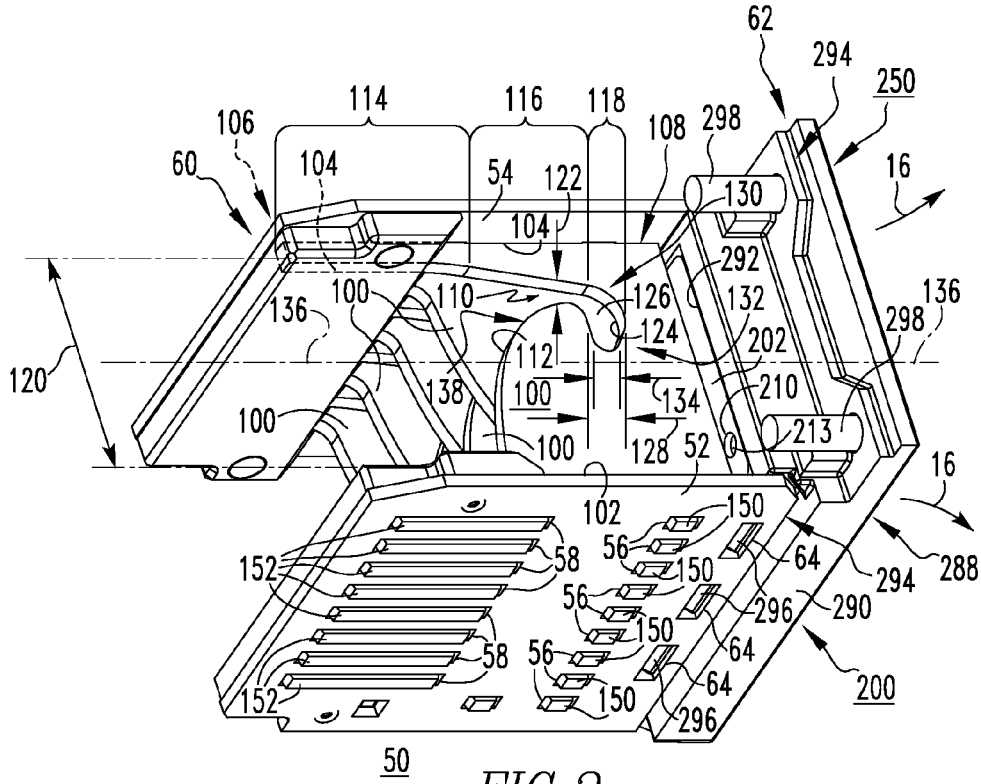
FIG. 2 is an isometric view of the arc chute assembly of FIG. 1.
Figure 5:
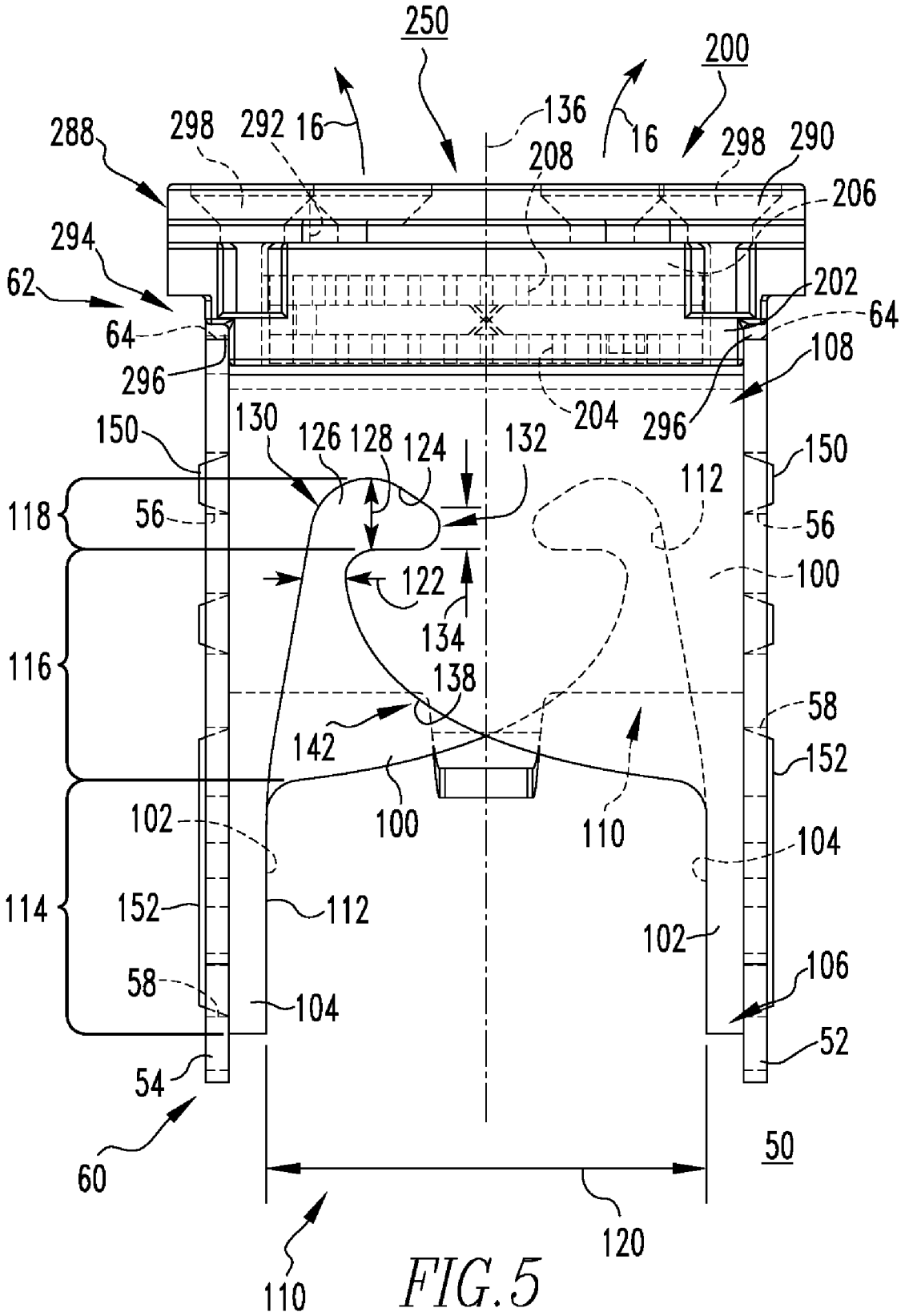
FIG. 5 is a top plan view of the arc chute assembly of FIG. 2, showing one arc plate in solid line drawing and a second, adjacent arc plate in hidden line drawing.

As best shown in FIGS. 2 and 5, each arc chute assembly 50 includes first and second opposing sidewalls 52,54 and a plurality of arc plates 100 disposed between the first and second opposing sidewalls 52,54. More specifically, each of the first and second opposing sidewalls 52,54 of the arc chute assembly 50 includes a plurality of apertures 56,58 (shown only on first opposing sidewall 52 of FIG. 2), and the arc plate 100 includes first and second portions or legs 102,104 each having a number of protrusions 150,152 (shown only in first opposing sidewall 52 of arc chute assembly 50 of FIG. 2). The apertures 56,58 of the first and second opposing sidewalls 52,54 each receive the protrusions 150,152 of a corresponding one of the first and second legs 102,104 of the arc plates 100, as best shown in FIG. 5.

Figure 3:
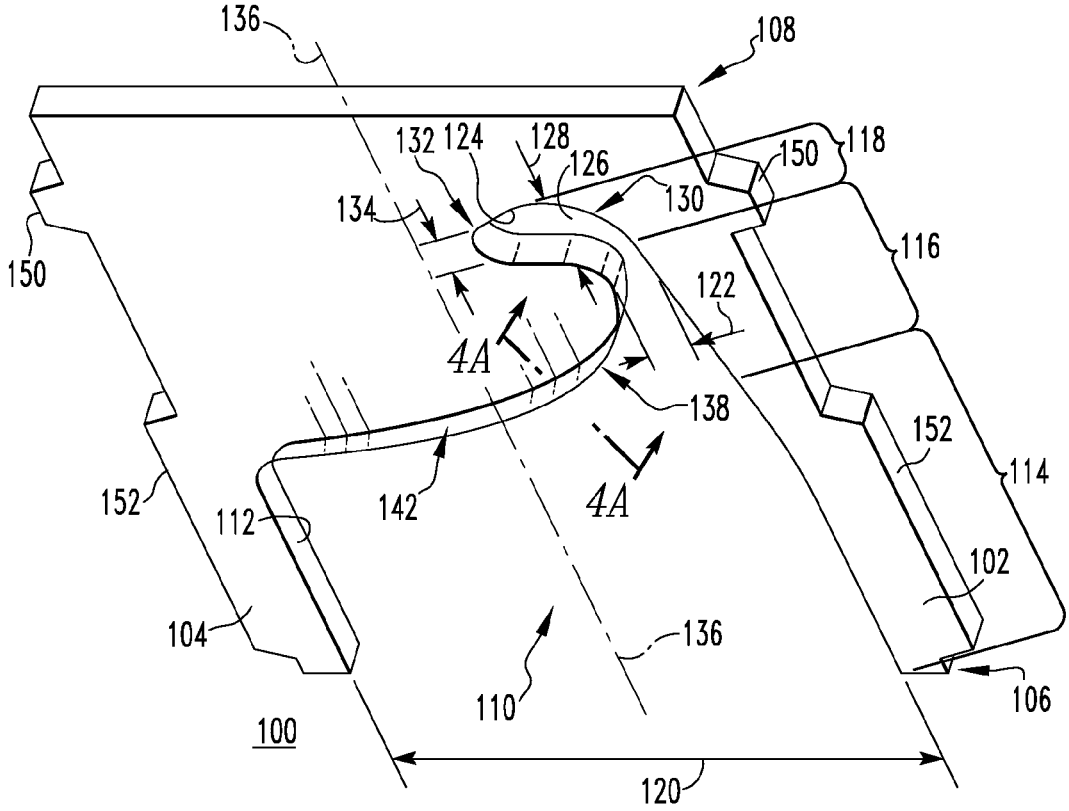
FIG. 3 is an isometric view of one of the arc plates for the arc chute assembly of FIG. 1.

Referring to FIGS. 2, 3 and 5, each arc plate 100 includes the first leg 102, which is structured to be coupled to one of the first and second opposing sidewalls 52,54 (FIGS. 2 and 5) of the arc chute assembly 50 (FIGS. 2 and 5) and the second leg 104 which is structured to be coupled to the other one of the first and second opposing sidewalls 52,54 (FIGS. 2 and 5) of arc chute assembly 50 (FIGS. 2 and 5), as previously discussed, a first end 106 structured to be disposed proximate the separable contacts 6,8 (FIG. 1) of the circuit breaker 2 (FIG. 1), a second end 108 disposed distal from the first end 106, and a throat portion 110 disposed between the first leg 102 and the second leg 104. The throat portion 110 includes an aperture 112 which extends from the first end 106 of the arc plate 100, toward the second end 108 thereof. The aperture 112 includes an end section 114, which is disposed at or about the first end 106 of the arc plate 100, an intermediate neck section 116, which is disposed adjacent the end section 114, and an interior section 118, which is disposed adjacent the intermediate neck section 116 and distal from the end section 114. The end section 114 of the aperture 112 has a first width 120, and is structured to attract the aforementioned arc 12 and direct it toward the intermediate neck section 116 of the aperture 112. The intermediate neck section 116 of the aperture 112 has a second width 122 and tapers from the first width 120 of end section 114 to the second width 122 of the intermediate neck section 116. The second width 122 is preferably less than the first width 120 of the end section 114 of aperture 112, as shown, in order to further attract the arc 12 (FIG. 1) and direct it into the interior section 118 of aperture 112 of throat portion 110. The interior section 118 of aperture 112 of the throat portion 110 also includes a taper 124, and turns with respect to the intermediate neck section 116 of the aperture 112, in order to retain the arc 12 (FIG. 1) therein. For example, from the perspective of FIG. 3, the interior section 118 of the example arc plate 100 turns left with respect to intermediate neck section 116 of the aperture 112 of throat portion 110 of the arc plate 100. However, it will be appreciated that the interior section 118 could alternatively turn or otherwise be configured in any suitable manner to attract and retain the arc 12 (FIG. 1).

Continuing to refer to FIGS. 2, 3 and 5, the structure of the throat portion 110 of arc plate 100 will now be described in further detail. Specifically, the interior section 118 of the aperture 112 of the throat portion 110 preferably comprises an expanded portion 126, such as the generally oblong cut-out 118, shown. The expanded portion 126 of the generally oblong cut-out 118 is disposed adjacent to intermediate neck section 116 of aperture 112, and includes a third width 128 which is greater than the second width 122 of the intermediate neck section 116 of aperture 112, but less than the first width 120 of the end section 114 of aperture 112. The generally oblong cut-out 118 has a first end 130 which comprises the expanded portion 126 of the interior section 118, a second end 132 having a fourth width 134, and a taper 124 generally extending therebetween. The fourth width 134 of the second end 132 of the generally oblong cut-out 118 is less than the third width 128 of the expanded portion 126 of the first end 130 of the generally oblong cut-out 118, as shown. The taper 124 helps to electromagnetically attract the arc 12 (FIG. 1) into the interior section 118 of the aperture 112 for retention therein. Specifically, when the arc is initiated in front of the arc plates, the magnetic forces are such that the arc 12 (FIG. 1) will begin to move toward section 138. Gas forces also help to drive the arc into the throat portion 110. As the arc 12 (FIG.

1) moves into the throat portion 110, the magnetic forces increases on the arc 12 (FIG. 1) because the throat portion 110 narrows. This forces the arc 12 (FIG. 1) into interior section 118 which is expanded to allow the arc 12 (FIG. 1) to expand and reside. If the arc 12 (FIG. 1) tries to move back out of the throat portion 110, the metal in section 116 will produce more metal vapor, forcing it back into interior section 118. Once it is in interior section 118, the arc 12 (FIG. 1) prefers to reside in the expanded portion 126 thereof. In this manner, the example arc plate 100 and, in particular, the interior section 118 of aperture 112 of the throat portion 110 of arc plate 100, overcomes the disadvantage (e.g., undesirable withdraw of the arc from the arc plate back towards the separable contacts of the circuit breaker) of the known prior art.

Although the generally oblong cut-out 118 of the example arc plate 100 shown and described herein extends generally perpendicularly from the intermediate neck section 116 of the aperture 112 of throat portion 110 of the arc plate 100, it will be appreciated that it could alternatively extend at any suitable angle (not shown) which would achieve the desired result of retaining the arc 12 (FIG. 1), as preciously discussed.

The arc plate 100 includes a center line 136 extending from the first end 106 to the second end 108 of the arc plate 100 intermediate the first and second legs 102,104 of the arc plate 100, as shown in FIGS. 2, 3 and 5. At least one of the intermediate neck section 116 and the interior section 118 of the aperture 112 of throat portion 110 of the arc plate 100 is asymmetric with respect to the centerline 136. In the example shown and described herein, both the intermediate neck section 116 and interior section 118 of the arc plates 100 are asymmetric with respect to the centerline 136.

As best shown in FIG. 5, the plurality of arc plates 100 (two arc plates 100 are shown in FIG. 5, a top (from the perspective of FIG. 5) arc plate 100 shown in solid line drawing, and underlying substantially identical arc plate 100 partially shown in hidden line drawing) of the arc chute assembly 50 are substantially identical and are disposed within the arc chute assembly 50 spaced one on top of another with the asymmetric portions 116,118 of the alternating arc plates 100 being disposed backwards with respect to the asymmetric portions 116,118 of adjacent substantially identical arc plates 100. In other words, as best shown in FIG. 5, every other arc plate 100 is flipped with respect to adjacent arc plates 100. For example, in FIG. 5, the top arc plate 100, shown in solid line drawing, is arranged within the arc chute assembly 50 such that the protrusions 150,152 of the first portion or leg 102 of the arc plate 100 are received by apertures 56,58 of the first opposing sidewall 52 of the arc chute assembly 50, and the protrusions 150,152 of the second portion or leg 104 of the arc plate 100 are received by apertures 56,58 of the second opposing sidewall 54 of the arc chute assembly 50. Conversely, the second arc plate 100, partially shown in hidden line drawing in FIG. 5, is coupled to the arc chute assembly 50 such that the protrusions 150,152 of the first portion or leg 102 of the arc plate 100 are received by apertures 56,58 of the second opposing sidewall 54 of the arc chute assembly 50, and the protrusions 150,152 of the second portion or leg 104 of the arc plate 100 are received by apertures 56,58 of the first opposing sidewall 52 of the arc chute assembly 50. In this manner, the substantially identical arc plates 100 are disposed opposite with respect to one another such that the aforementioned asymmetric portions (e.g., intermediate neck section 116 and interior section 118) are mirrored with respect to one another about centerline 136. It will, however, be appreciated that the arc plate 100 need not necessarily be identical. It will also be appreciated that the plurality of arc plates 100 of the arc chute assembly 50 can be arranged in any other known or suitable configuration other than the alternating back-and-forth arrangement shown in FIGS. 2 and 5. For example and without limitation, the sections 114,116,118 of each arc plate 100 of arc chute assembly 50 could be slightly different (not shown), and the arc plates 100 could be stacked within the arc chute assembly 50 all having the same orientation (not shown), in order to direct the arc 12 (FIG. 1) within the arc chute assembly 50 in any predetermined desired manner.

Figure 4A:
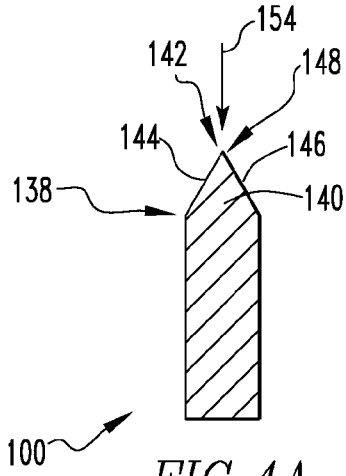
FIG. 4A is a cross-sectional view taken along line 4A-4A of FIG. 3, showing the double-sided edge profile of the throat portion of one of the arc plates of the arc chute assembly.

As best shown in FIG. 3, the aperture 112 of throat portion 110 of arc plate 100 further includes an edge 138. The edge 138 has a cross-sectional profile 140 which is shown in FIG. 4A. Specifically, as shown in FIG. 4A, at least a portion 142 of the edge 138 of the aperture 112 (FIG. 3) of the throat portion 110 (FIG. 3) is tapered in order to further attract the arc 12 (FIG. 1) into the aperture 112 (FIG. 3) of throat portion 110 (FIG. 3) of the arc plate 100. It will be appreciated that the portion 142 of the edge 138 of aperture 112 (FIG. 3) may comprise the entire edge (not shown) of the aperture 112 (FIG. 3) of the throat portion 110 (FIG. 3), or only a smaller section of the aperture 112 (FIG. 3), such as, for example, the intermediate neck section 116 of the aperture 112 in the example of FIG. 3, which is tapered.

Figure 4B:
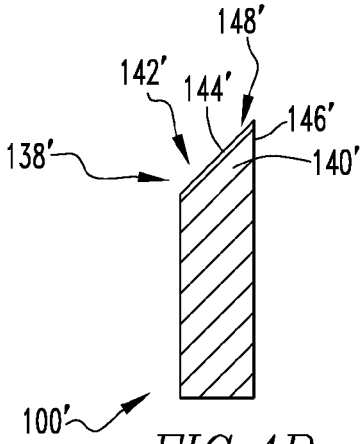
FIG. 4B is a cross-sectional view showing a single-side edge profile for the throat portion of an arc plate.

More specifically, FIGS. 4A and 4B illustrate two non-limiting alternative cross-sectional profiles 140,140' for the portion 142,142' of the edge 138,138' of the aperture 112 (FIG. 3) of throat portion 110 (FIG. 3), respectively. In the example of FIG. 4A, the portion 142 of the edge 138 of the throat portion 110 (FIG. 3) of the arc plate 100 has a first side 144 and a second side 146, both of which include a taper 148. In this manner, the tapered portion 142 of edge 138 functions to electromagnetically attract the aforementioned arc 12 (FIG. 1) toward the arc plate 100 in the direction generally indicated by arrow 154 in FIG. 4A. This further serves to direct the arc 12 (FIG. 1) within the arc plate 100, and retain it therein, as desired.

In the example of FIG. 4B, the tapered portion 142' of the edge 138' of arc plate 100' includes a taper 148' on the first side 144' of portion 142', but not the second side 146' thereof. It will, however, be appreciated that any known or suitable tapered edge cross-sectional profile other than the examples shown and described herein could be alternatively employed without departing from the scope of the invention. It will further be appreciated that in other embodiments of the invention, no taper (e.g., 148,148') of any portion of the edge 138 of the arc plate 100 is employed.

It will also be appreciated that although the arc plates 100 have been shown and described herein with respect to a single arc chute assembly 50 (FIGS. 1, 2, and 5) for a circuit breaker 2 (FIG. 1), the electrical switching apparatus (e.g., circuit breaker 2) could employ more than one arc chute assembly 50 each having a plurality of arc plates 100. For example, and without limitation, the circuit breaker 2 (FIG. 1) could be a multi-pole circuit breaker 2 having a plurality poles (only one pole 14 is expressly shown in FIG. 1) and a corresponding number of arc chute assemblies 50 with arc plates 100 for the poles 14 of the multi-pole circuit breaker 2.

Accordingly, an arc plate geometry and arc chute assembly configuration are disclosed which effectively attract, direct, and retain arcs generated, for example, by the tripping open of the separable contacts 6,8 (FIG. 1) of the circuit breaker 2 (FIG. 1) in response to an electrical fault. Thus, such arcs 12 (FIG. 1) are advantageously drawn away from the separable contacts 6,8 (FIG. 1) and dissipated.

In addition to the aforementioned arc plates 100, the example arc chute assemblies 50 of circuit breaker 2 (FIG. 1) further include an arc baffle 200 for discharging ionized gasses (generally indicated by arrow 16 in FIGS. 1, 2 and 5) produced as a byproduct of the arc 12 (FIG. 1).

Figure 6:
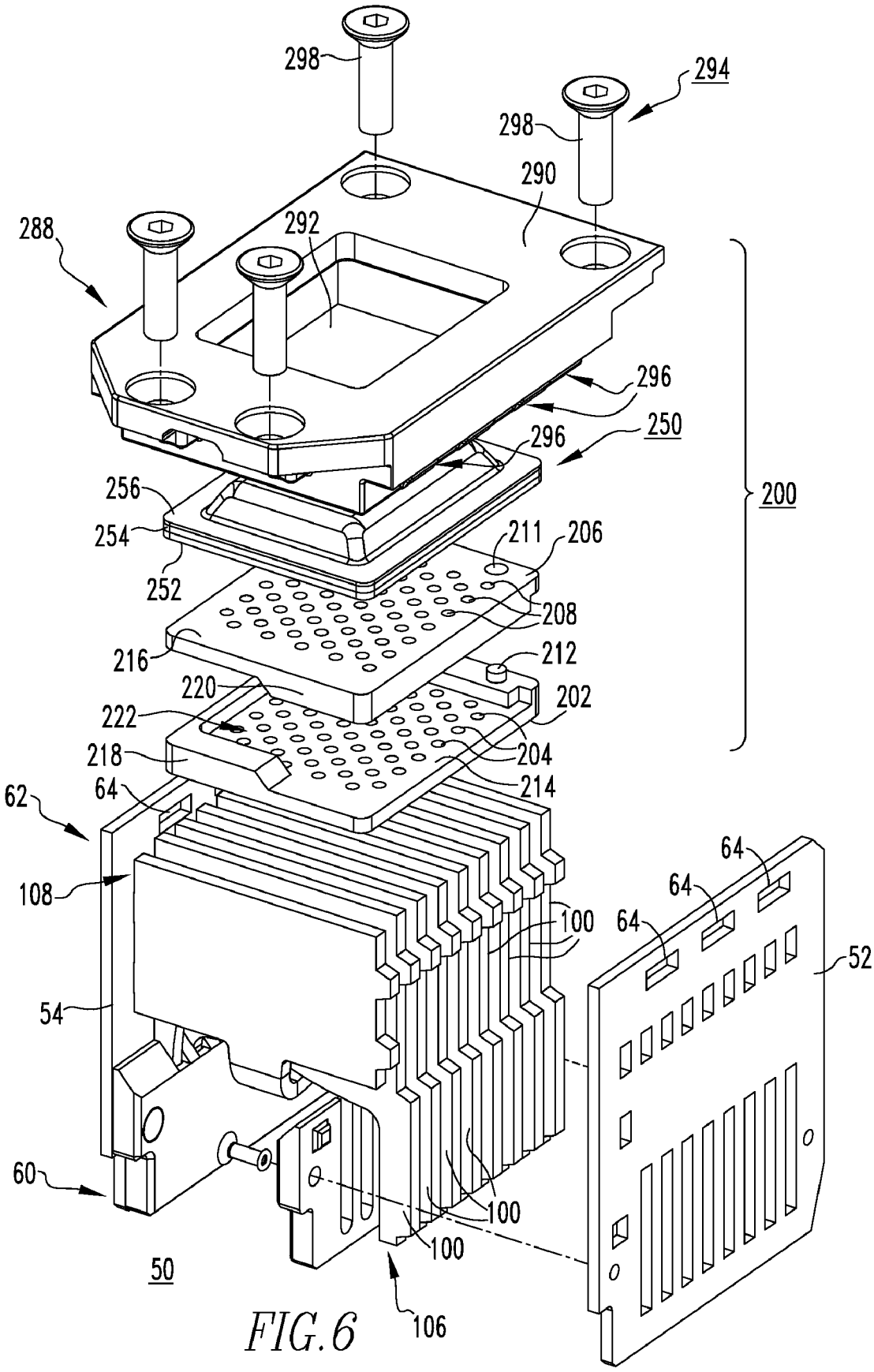
FIG. 6 is an exploded isometric view of the arc chute assembly, and the arc plates and arc baffles therefor, of FIG. 1.
Figure 7A:
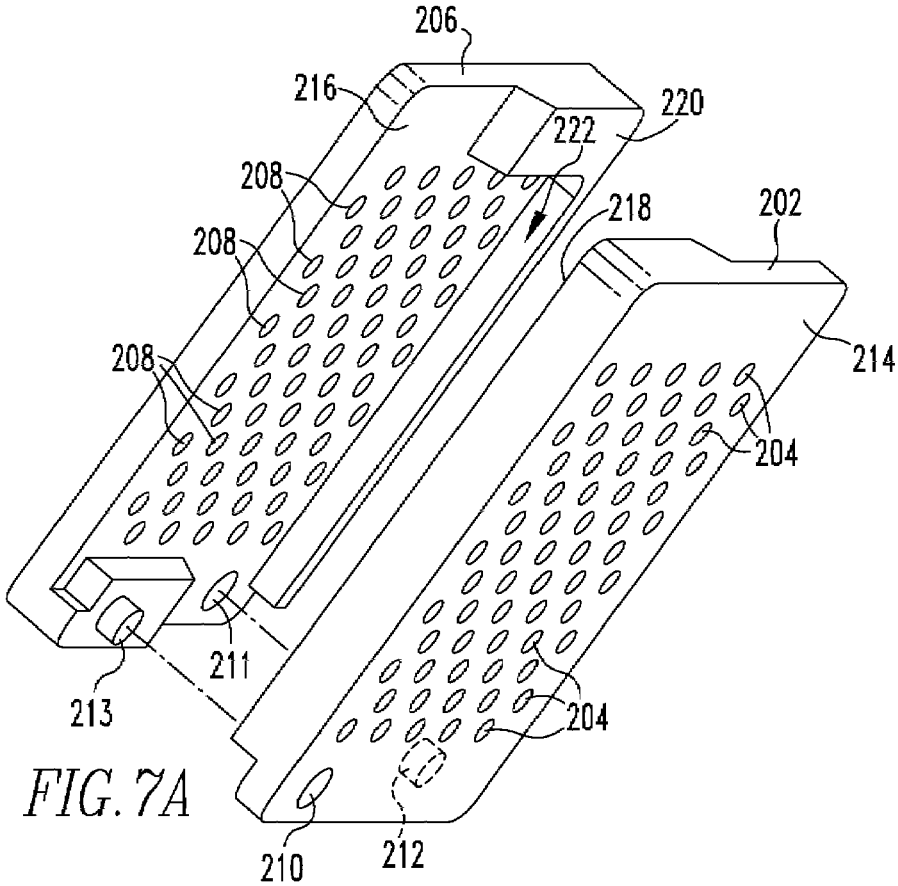
FIGS. 7A and 7B are isometric exploded and assembled views, respectively, of the arc baffles of FIG. 1.
Figure 7B:
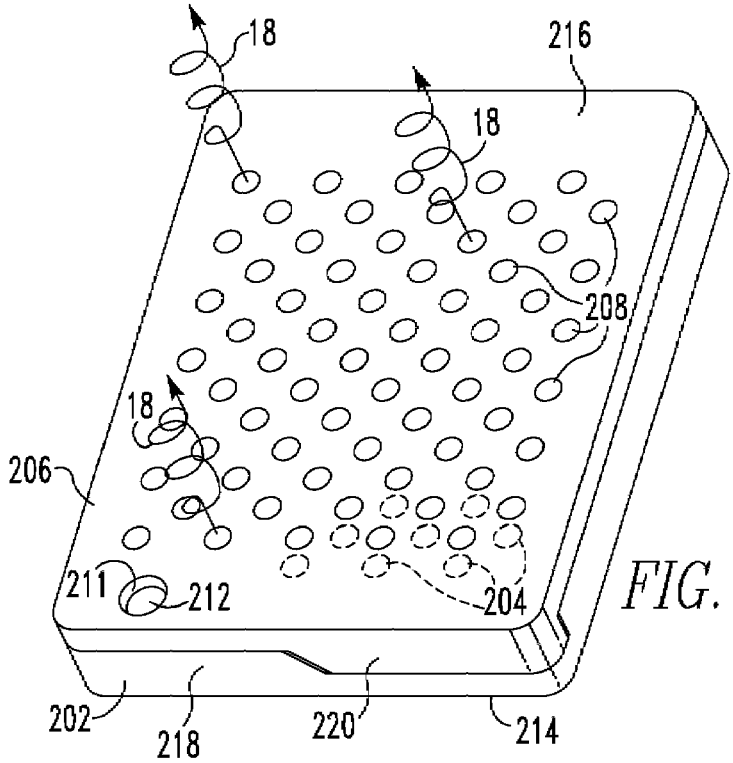

Specifically, as best shown in FIGS. 6, 7A, and 7B, the arc baffle 200 includes a first baffle member 202 and a second baffle member 206 coupled to and disposed opposite from the first baffle member 202. The first baffle member 202 includes a plurality of first venting holes 204 which are offset with respect to a plurality of second venting holes 208 of the second baffle member 206, in order to induce turbulent flow 18 (indicated generally by arrows 18 of FIG. 7B) of the ionized gases 16 (FIGS. 1, 2 and 5) being discharged from the second end 62 (FIGS. 1, 2, 5, and 6) of the arc chute assembly 50 (FIGS. 1, 2, 5, and 6). Thus, the first baffle member 202 is structured to be disposed at or about the second end 62 of arc chute assembly 50, and the second ends 108 of the arc plates 100 thereof, as shown in FIG. 6.

The first and second baffle members 202,206 are substantially the same. More specifically, as best shown in FIG. 7A, the first baffle member is a first molded member 202 including at least one first recess 210 and at least one first protrusion 212 (shown in hidden line drawing in FIG. 7A), and the second baffle member is a second molded member 206 including at least one second recess 211, which is substantially identical to first recess 210, and at least one second protrusion 213, which is substantially identical to first protrusion 212. In the example shown and described herein, each molded member 202,206 includes a single protrusion 212, 213, and a single recess 210,211. When the first and second baffle members 202,206 are assembled as shown in FIG. 7B, the first protrusion 212 of the first molded member 202 is disposed within corresponding second recess 21 1 of second molded member 206, and second protrusion 213 (FIG. 7A) is disposed within corresponding first recess 210 (FIG. 7A) of the first molded member 202. It will, however, be appreciated that any known or suitable alternative fastening mechanism (not shown) for securing the substantially similar first and second baffle members 202,206 together could be employed without departing from the scope of the invention.

Continuing to refer to FIGS. 7A and 7B, each of the first and second molded members 202,206 further includes a generally planar portion 214,216 and a spacer portion 218,220 protruding from the generally planar portion 214,216. The aforementioned first and second venting holes 204,208 are disposed in the generally planar portions 214,216 of the first and second molded members 202,206, respectively. When the first and second baffle members 202,206 are coupled together as shown in FIG. 7B, the first spacer portion 218 of the first molded member 202 engages the generally planar portion 216 of a second molded member 206, and the second spacer portion 220 of second molded member 206 engages the generally planar portion 214 of the first molded member 202. In this manner, the generally planar portions 214,216 of the first and second molded members 202,206 are spaced apart from one another in order to provide an air gap 222 (indicated generally by arrow 222 of FIG. 7A) therebetween. The air gap 222, in addition to the aforementioned offset of the first and second venting holes 204,208 (best shown in FIG. 7B), is structured to further cool and dissipate the ionized gases 16 (FIGS. 1, 2 and 5) discharged from the arc chute assembly 50 (FIGS. 1, 2, 5, and 6). The exact dimension of air gap 222 is not meant to be a limiting aspect of the invention, but preferably is suitably sized and configured so as to facilitate the aforementioned inducement of turbulent flow 18 (FIG. 7B).

Figure 8A:
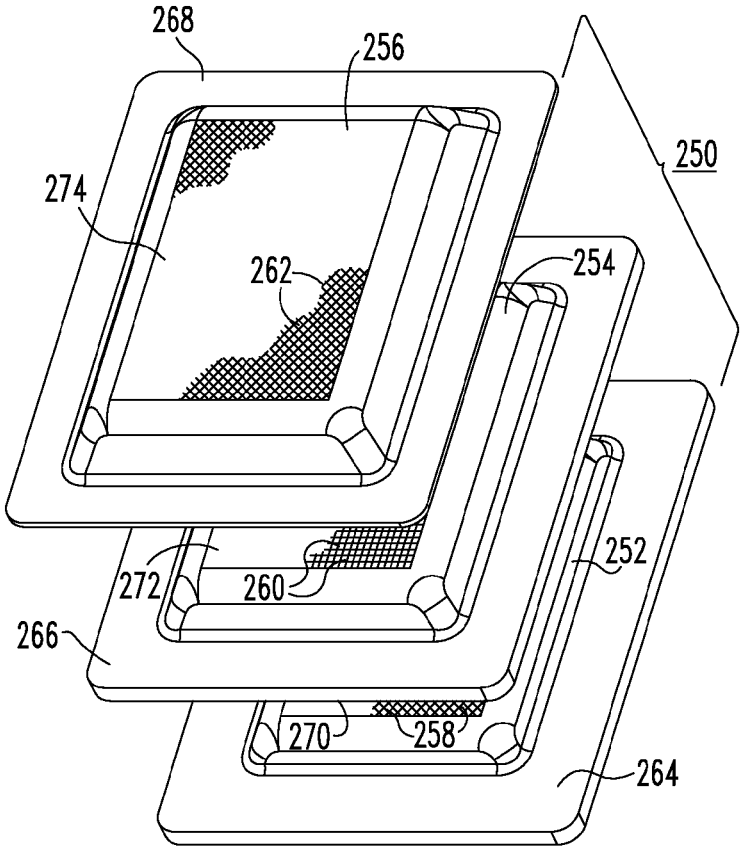
FIGS. 8A and 8B are isometric top and assembled side elevational views, respectively, of a filter assembly for arc baffles, in accordance with an embodiment of the invention.
Figure 8B:
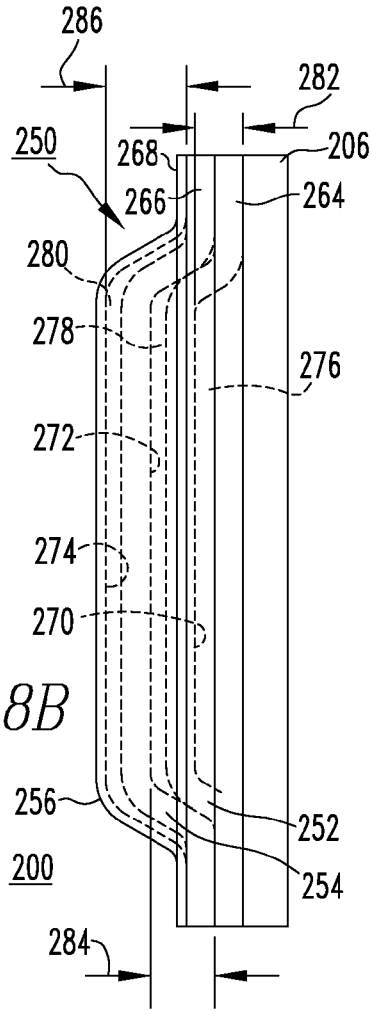

As best shown in FIGS. 6 and 8B, the example arc baffle 200 further includes a filter assembly 250 disposed at or about the second baffle member 206 and including a number of filter elements 252,254,256 which are structured to filter the turbulent flow 18 (FIG. 7B) as it exits the first and second baffle member assembly 202,206 (only second baffle member 206 is shown in FIG. 8B). More specifically, as best shown in FIGS. 8A and 8B, the filter elements 252,254,256 of the filter assembly 250 comprise a number of mesh members, such as the first, second, and third wire meshes 252,254,256, shown. Thus, the filter assembly 250 is structured to permit the ionized gases 16 (FIGS. 1, 2, and 5) to flow therethrough, with the first, second, and third wire meshes 252,254,256 being layered in order to control such flow of the ionized gases 16, by way of corresponding apertures 258,260,262 in the respective wire mesh members 252,254,256.

In particular, as best shown in FIG. 8A, the apertures 258, 260,262 of each of the first, second, and third wire meshes 252,254,256 are offset with respect to the apertures 258,260, 262 of at least one other of the first, second, and third wire meshes 252,254,256 in order to restrict the flow of the ionized gases 16 (FIGS. 1, 2 and 5) through the filter assembly 250. In the example of FIG. 8A, the apertures 258,262 (partially shown) of the first and third wire meshes 252,256 comprise diagonal wire meshes 252,256 which are offset with respect to the apertures 260 of the vertical and horizontal second wire mesh 254. However, as will be appreciated with reference to FIG. 9 and the EXAMPLES set forth hereinbelow, any known or suitable configuration of wire meshes (e.g., without limitation, 252,254,256) or other suitable filter elements (not shown), in any known or suitable number (not shown) other than that shown and described herein, could be employed to provide the desired filtering properties for filter assembly 250. For example and without limitation, although the wire meshes 252,254,256 are contemplated as being "cupped," or formed to include a recessed portion as discussed below, they could alternatively be substantially flat. It will also be appreciated, as will be discussed, that a separate filter assembly is not required.

Continuing to refer to FIG. 8A, and also to FIG. 8B, the example first, second, and third wire meshes 252,254,256 each also respectively include a flange portion 264,266,268 and a recessed portion 270,272,274. Specifically, as best shown in FIG. 8B, the recessed portion 270 of the first wire mesh 252 is disposed within and generally conforms to the recessed portion 272 of the second wire mesh 254, and the recessed portion 272 of the second wire mesh 254 is disposed within and generally conforms to the recessed portion 274 of the third wire mesh 256. The flange portion 264 of at least the first wire mesh 252 is disposed at or about the second baffle member 206, in order that the recessed portions 270,272,274 of each of the first, second, and third wire meshes 252,254, 256 is spaced from at least one of: (a) the recessed portion 270,272,274 of another one of the first, second, and third wire meshes 252,254,256, and (b) the second baffle member 206, thereby providing at least one air gap 276 for further cooling and dissipating the ionized gases 16 (FIGS. 1, 2 and 5). In the example of FIG. 8B, the recessed portion 270 of the first wire mesh 252 has a first depth 282, in order to provide a first air gap 276 between second baffle member 206 and the first recessed portion 270 of the first wire mesh 252, as shown. The second recessed portion 272 of the second wire mesh 254 has a second depth 284 in order to provide a second air gap 278 between the recessed portion 270 of the first wire mesh 252 and the recessed portion 272 of the second wire mesh 254, and the recessed portion 274 of the third wire mesh 256 has a third depth 286 in order to provide a third air gap 280 between recess portion 272 of second wire mesh 254 and recessed portion 274 of the third wire mesh 256. The precise dimensions and configuration of the first, second, and third air gaps 276,278,280 are not meant to be a limiting aspect of the invention. Any known or suitable alternative number of air gaps (not shown) could be employed in any suitable configuration which would provide the desired control (e.g., filtering and restriction) of the ionized gases 16 (FIGS. 1, 2 and 5). It will also be appreciated that while the first and second wire mesh filter elements 252,254 are shown as being substantially identical and employed in combination with third wire mesh 256 which is different (i.e., thinner), that any known or suitable number and configuration of suitable filter elements could be employed in order to filter the flow of discharged ionized gases 16 (FIGS. 1, 2 and 5), as desired.

Referring again to FIG. 6, the example arc baffle 200 includes a baffle mount 288 for coupling the aforementioned first and second baffle members 202,206 and filter assembly 250 to the arc chute assembly 50. Specifically, the baffle mount 288 includes a generally planar member 290 having an opening 292 therethrough, for discharging the ionized gases 16 (FIGS. 1, 2 and 5). The baffle mount 288 also includes a fastening mechanism 294 for coupling the baffle mount 288 and arc baffle 200 to the arc chute assembly 50. Thus, it will be appreciated that in a multi-pole electrical switching apparatus, such as the circuit breaker 2 of FIG. 1, wherein the circuit breaker 2 includes a plurality of poles 14 (one pole 14 is shown in FIG. 1) each having an arc chute assembly 50, a separate arc baffle 200 is secured to each arc chute assembly 50 by a corresponding baffle mount 288. The example baffle mount 288 employs a plurality of fasteners, such as the rivets 298 shown in FIG. 6, to secure the baffle mount 288 and arc baffle 200 to the housing 4 (FIG. 1) of the circuit breaker 2 (FIG. 1), and further includes a plurality of tabs 296 (FIGS. 2, 5 and 6) protruding from the baffle member 288 and engaging corresponding openings 64 in the first and second opposing sidewalls 52,54 of the arc chute assembly 50. Accordingly, as best shown in FIG. 6, when the arc chute assembly 50 is assembled with the baffle mount 288 coupled thereto, the filter assembly 250 is disposed between the baffle mount 288 and the second baffle member 206 in order that a portion of at least one of the filter elements 252,254,256 of the filter assembly 250 is disposed in the opening 292 of the generally planar member 290 of the baffle mount 288, and the first and second baffle members 202,206 are disposed between the filter assembly 250 and the second ends 108 of arc plates 100 of the arc chute assembly 50.

Figure 9:
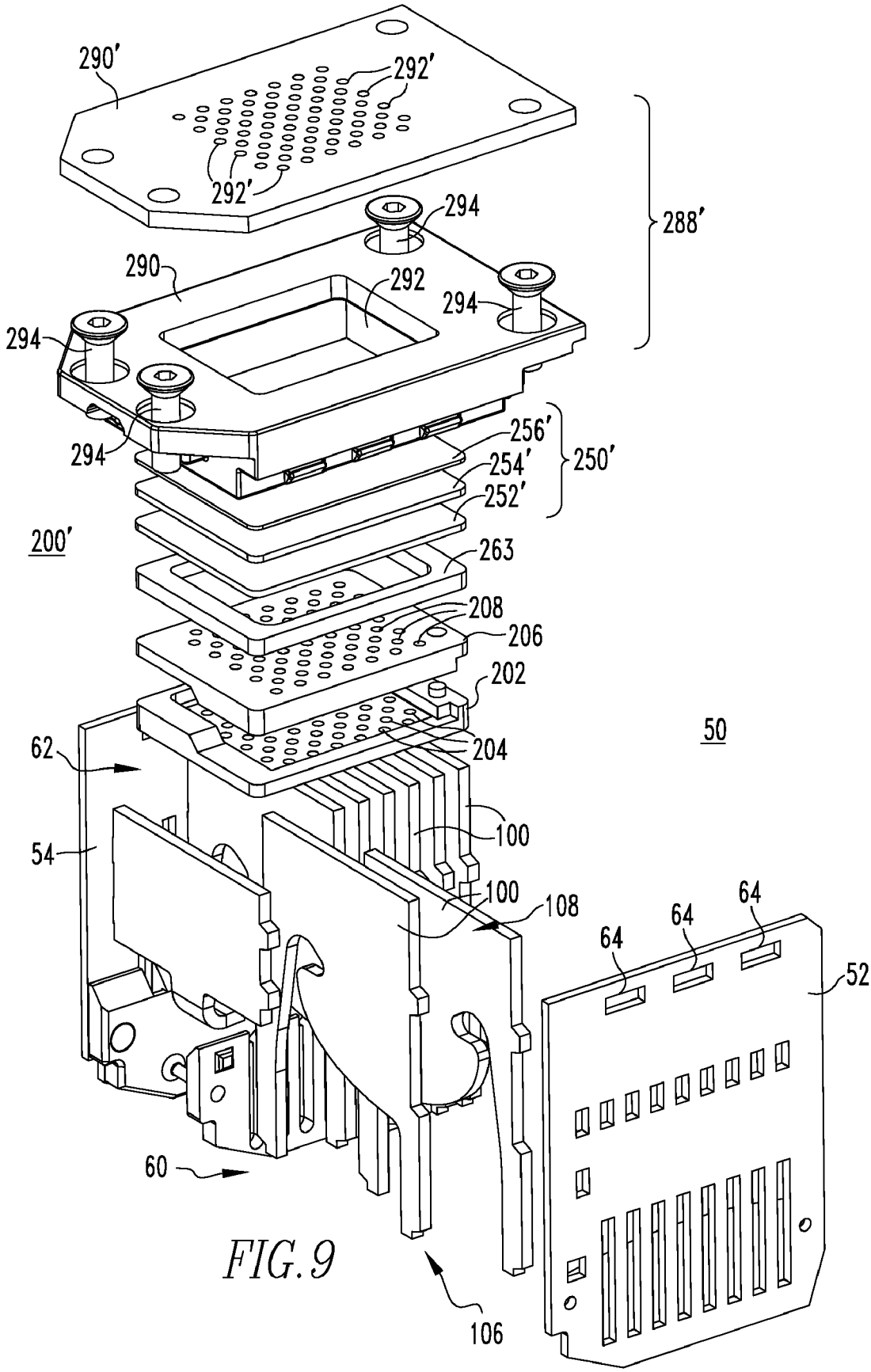
FIG. 9 is an isometric exploded view of an arc chute assembly, and arc plates and arc baffles therefor, in accordance with another embodiment of the invention.

As previously discussed, it will be appreciated that the arc baffle 200 could comprise a wide variety of alternative configurations from those described hereinabove, without departing from the scope of the invention. FIG. 9 illustrates one such example.

Specifically, FIG. 9 shows an arc baffle 200' for the arc chute assembly 50. In addition to the aforementioned first and second baffle members 202,206, the arc baffle 200' employs a filter assembly 250' including three substantially flat filter elements 252',254',256' (e.g., without limitation, wire mesh) and a spacer 263. The arc baffle 200' also includes a baffle mount 288' which, in addition to generally planar member 290, previously discussed, also includes a generally planar member 290' having a plurality of openings 292'. More specifically, the openings 292' of the generally planar member 290' comprise a plurality of third venting holes 292' which are spaced from and offset with respect to the plurality of second venting holes 208 of the second baffle member 206. In this manner, the arc baffle 200' and, in particular, the third venting holes 292' thereof, allow for turbulent mixing of the ionized gases 16 (FIGS. 1, 2 and 5) as they are discharged from the second end 62 of the arc chute assembly 50. The spacer 263 is disposed between second baffle member 206 and substantially flat filter element 252' in order to provide the desired spacing and associated flow of the ionized gases 16. The exact size of the components (e.g., without limitation, spacer 263; wire meshes 252',254',256'; generally planar members 290, 290') are not meant to be a limiting aspect of the invention.

The following EXAMPLES provide still further non-limiting variations of the arc baffle 200' of FIG. 9 and of arc baffle 200, previously discussed with respect to FIG. 6.

EXAMPLE 1

It will be appreciated that the baffle mount 288' preferably comprises one single component (not shown), wherein the generally planar members 290,290' of the baffle mount 288' are made (e.g., without limitation, molded) from one single piece of material, as opposed to comprising two separate components as shown and described with respect to FIG. 9.

EXAMPLE 2

The filter assemblies 250 (FIG. 6), 250' (FIG. 9) of the arc baffle 200 (FIG. 6), 200' (FIG. 9) can employ any known or suitable number and type (e.g., without limitation, substantially flat; formed or "cupped") of filter elements 252,254,256 (FIG. 6), 252',254',256' (FIG. 9), with or without spacer(s) 263 (FIG. 9).

EXAMPLE 3

The arc baffle 200 (FIG. 6), 200' (FIG. 9) can employ the baffle mount 288 (FIG. 6), 288' (FIG. 9) without the filter assembly 250 (FIG. 6), 250' (FIG. 9), and without the first and second baffle members 202,206. Under such circumstances, the baffle mount 288 (FIG. 6), 288' (FIG. 9) serves as the sole baffle member for facilitating the discharge of the ionized gases 16 (FIGS. 1, 2 and 5) from the arc chute assembly 50.

EXAMPLE 4

The baffle mount 288 (FIG. 6), 288' (FIG. 9) of the arc baffle 200 (FIG. 6), 200' (FIG. 9) can be employed without the filter assembly 250 (FIG. 6), 250' (FIG. 9), but with any known or suitable number and configuration of additional baffle members, such as first and second baffle members 202,206 of FIGS. 6 and 9. Spacers (e.g., spacer 263 of FIG. 9) can also be employed, as necessary, to provide the desired spacing between the baffle members 202,206 and the baffle mount 288 (FIG. 6), 288' (FIG. 9).

In view of the foregoing, it will be appreciated that the disclosed arc baffle 200,200' can be adapted for use with a wide variety of arc chute assemblies 50, in order to effectively discharge the ionized gases 16 (FIGS. 1, 2 and 5) therefrom.

Accordingly, embodiments of the invention provide an arc baffle 200,200' which effectively cools, dissipates and discharges ionized gases 16 from the arc chute assemblies 50 of electrical switching apparatus (e.g., without limitation, circuit breaker 2 of FIG. 1), thereby minimizing the potential for undesirable electrical faults (e.g., short circuits) commonly caused by such ionized gases, and other disadvantages associated therewith. Additionally, the arc baffle 200,200' provides a solution to such disadvantages which is cost-effective by employing components (e.g., the first and second baffle members 202,206 and first and second filter elements 252, 254,252',254') that are substantially identical, thereby minimizing manufacturing costs associated therewith.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An arc baffle for an electrical switching apparatus including a housing, separable contacts enclosed by said housing, and at least one arc chute assembly, said at least one arc chute assembly having a first end and a second end, the first end being disposed proximate said separable contacts in order to attract an arc generated by said separable contacts being opened, the second end being disposed distal from the first end for discharging ionized gases produced as a byproduct of said arc, said arc baffle comprising:

a number of baffle members comprising a first baffle member and a second baffle member each including a generally planar discharge portion having a periphery and at least one opening for discharging said ionized gas, and an elongated spacer portion protruding outwardly from the periphery; and a plurality of fasteners structured to couple said arc baffle and said baffle members to said arc chute assembly at or about the second end of said arc chute assembly, wherein said first baffle member and said second baffle member interlock to form an air gap therebetween, and wherein the elongated spacer portion of said first baffle member engages the generally planar discharge portion of said second baffle member, and the elongated spacer portion of said second baffle member engages the generally planar discharge portion of said first baffle member, thereby substantially enclosing said air gap.

2. The arc baffle of claim 1 wherein said number of baffle members further comprises a baffle mount; wherein said discharge portion of said baffle mount comprises a generally planar member; and wherein said at least one opening of said baffle mount is disposed in said generally planar member of said baffle mount.

3. The arc baffle of claim 1 wherein said first baffle member is structured to be disposed at or about the second end of said at least one arc chute assembly and includes a plurality of first venting holes; wherein said second baffle member includes a plurality of second venting holes and is coupled to and disposed opposite from said first baffle member; wherein said first venting holes of said first baffle member are offset with respect to said second venting holes of said second baffle member and are structured to induce turbulent flow of said ionized gases being discharged from the second end of said at least one arc chute assembly; and wherein said first baffle member and said second baffle member are substantially the same.

4. An arc baffle for an electrical switching apparatus including a housing, separable contacts enclosed by said housing, and at least one arc chute assembly, said at least one arc chute assembly having a first end and a second end, the first end being disposed proximate said separable contacts in order to attract an arc generated by said separable contacts being opened, the second end being disposed distal from the first end for discharging ionized gases produced as a byproduct of said arc, said arc baffle comprising:

a number of baffle members comprising a first baffle member and a second baffle member each including a generally planar discharge portion having a periphery and at least one opening for discharging said ionized gas, and an elongated spacer portion protruding outwardly from the periphery; and a filter assembly disposed at or about said baffle members and including a number of filter elements, wherein said at least one opening of said baffle members is structured to induce turbulent flow of said ionized gases being discharged from the second end of said at least one arc chute assembly, wherein said filter elements of said filter assembly filter said turbulent flow, wherein said first baffle member and said second baffle member interlock to form an air gap therebetween, and wherein the elongated spacer portion of said first baffle member engages the generally planar discharge portion of said second baffle member, and the elongated spacer portion of said second baffle member engages the generally planar discharge portion of said first baffle member, thereby substantially enclosing said air gap.

5. The arc baffle of claim 4 wherein said number of baffle members further comprise a baffle mount; wherein said baffle mount includes a generally planar member; wherein said at least one opening of said baffle mount is disposed in said generally planar member of said baffle mount; and wherein said filter elements of said filter assembly comprise a plurality of mesh members structured to be disposed between said baffle mount and the second end of said arc chute assembly.

6. The arc baffle of claim 4 wherein said mesh members are substantially flat; and wherein said filter assembly further comprises a spacer disposed between one of said baffle members and a corresponding one of said mesh members of said filter assembly.

7. The arc baffle of claim 4 wherein said first baffle member is structured to be disposed at or about the second end of said at least one arc chute assembly and includes a plurality of first venting holes; wherein said second baffle member includes a plurality of second venting holes and is coupled to and disposed opposite from said first baffle member; wherein said first venting holes of said first baffle member are offset with respect to said second venting holes of said second baffle member and are structured to induce turbulent flow of said ionized gases being discharged from the second end of said at least one arc chute assembly; and wherein said filter elements of said filter assembly filter said turbulent flow.

8. The arc baffle of claim 7 wherein said first baffle member and said second baffle member are substantially the same.

9. An arc baffle for an electrical switching apparatus including a housing, separable contacts enclosed by said housing, and at least one arc chute assembly, said at least one arc chute assembly having a first end and a second end, the first end being disposed proximate said separable contacts in order to attract an arc generated by said separable contacts being opened, the second end being disposed distal from the first end for discharging ionized gases produced as a byproduct of said arc, said arc baffle comprising:

a number of baffle members, each of said baffle members including a discharge portion having at least one opening for discharging said ionized gas; and a filter assembly disposed at or about said baffle members and including a number of filter elements, wherein said at least one opening of said baffle members is structured to induce turbulent flow of said ionized gases being discharged from the second end of said at least one arc chute assembly, wherein said filter elements of said filter assembly filter said turbulent flow, wherein said baffle members comprise at least a first baffle member structured to be disposed at or about the second end of said at least one arc chute assembly and including a plurality of first venting holes, and a second baffle member including a plurality of second venting holes and being coupled to and disposed opposite from said first baffle member; wherein said first venting holes of said first baffle member are offset with respect to said second venting holes of said second baffle member and are structured to induce turbulent flow of said ionized gases being discharged from the second end of said at least one arc chute assembly, and wherein said filter elements of said filter assembly filter said turbulent flow, and wherein said first baffle member is a first molded member comprising at least one first recess and at least one first protrusion; wherein said second baffle member is a second molded member comprising at least one second recess and at least one second protrusion; and wherein each of said at least one first protrusion of said first molded member is disposed within a corresponding one of said at least one second recess of said second molded member, and each of said at least one second protrusion of said second molded member is disposed within a corresponding one of said at least one first recess of said first molded member.

10. The arc baffle of claim 9 wherein each of said first molded member and said second molded member further comprise a generally planar portion and a spacer portion protruding from said generally planar portion; wherein said first venting holes and said second venting holes are disposed in said generally planar portion of said first molded member and said generally planar portion of said second molded member, respectively; wherein said spacer portion of said first molded member engages said generally planar portion of said second molded member, and said spacer portion of said second molded member engages said generally planar portion of said first molded member, in order that said generally planar portion of said first molded member and said generally planar portion of said second molded member are spaced apart from one another to provide an air gap therebetween; and wherein said air gap is structured to cool and dissipate said ionized gases.

11. The arc baffle of claim 7 wherein said filter assembly is structured to permit said ionized gases to flow therethrough; wherein said filter elements of said filter assembly comprise a plurality of mesh members; wherein each of said mesh members has a plurality of apertures; and wherein said mesh members are layered in order to control the flow of said ionized gases through said apertures.

12. The arc baffle of claim 11 wherein said mesh members comprise a first wire mesh, a second wire mesh, and a third wire mesh; wherein each of said first wire mesh, said second wire mesh, and said third wire mesh comprises a plurality of apertures; and wherein said apertures of each of said first wire mesh, said second wire mesh, and said third wire mesh are offset with respect to said apertures of at least one other of said first wire mesh, said second wire mesh, and said third wire mesh, in order to restrict the flow of said ionized gases through said filter assembly.

13. An arc baffle for an electrical switching apparatus including a housing, separable contacts enclosed by said housing, and at least one arc chute assembly, said at least one arc chute assembly having a first end and a second end, the first end being disposed proximate said separable contacts in order to attract an arc generated by said separable contacts being opened, the second end being disposed distal from the first end for discharging ionized gases produced as a byproduct of said arc, said arc baffle comprising:

a number of baffle members, each of said baffle members including a discharge portion having at least one opening for discharging said ionized gas; and a filter assembly disposed at or about said baffle members and including a number of filter elements, wherein said at least one opening of said baffle members is structured to induce turbulent flow of said ionized gases being discharged from the second end of said at least one arc chute assembly, wherein said filter elements of said filter assembly filter said turbulent flow, wherein said baffle members comprise at least a first baffle member structured to be disposed at or about the second end of said at least one arc chute assembly and including a plurality of first venting holes, and a second baffle member including a plurality of second venting holes and being coupled to and disposed opposite from said first baffle member; wherein said first venting holes of said first baffle member are offset with respect to said second venting holes of said second baffle member and are structured to induce turbulent flow of said ionized gases being discharged from the second end of said at least one arc chute assembly, and wherein said filter elements of said filter assembly filter said turbulent flow, wherein said mesh members comprise a first wire mesh, a second wire mesh, and a third wire mesh; wherein each of said first wire mesh, said second wire mesh, and said third wire mesh comprises a plurality of apertures; and wherein said apertures of each of said first wire mesh, said second wire mesh, and said third wire mesh are offset with respect to said apertures of at least one other of said first wire mesh, said second wire mesh, and said third wire mesh, in order to restrict the flow of said ionized gases through said filter assembly, and wherein each of said first wire mesh, said second wire mesh, and said third wire mesh further comprises a flange portion and a recessed portion; wherein said recessed portion of said first wire mesh is disposed within and generally conforms to said recessed portion of said second wire mesh, and said recessed portion of said second wire mesh is disposed within and generally conforms to said recessed portion of said third wire mesh; and wherein said flange portion of at least said first wire mesh is disposed at or about said second baffle member in order that said recessed portion of each of said first wire mesh, said second wire mesh, and said third wire mesh is spaced from at least one of: said recessed portion of another one of said first wire mesh, said second wire mesh, and said third wire mesh, and said second baffle member, thereby providing at least one air gap being structured to further cool and dissipate said ionized gases.

14. The arc baffle of claim 13 wherein said recessed portion of said first wire mesh has a first depth in order to provide a first air gap between said second baffle member and said recessed portion of said first wire mesh; wherein said recessed portion of said second wire mesh has a second depth in order to provide a second air gap between said recessed portion of said first wire mesh and said recessed portion of said second wire mesh; and wherein said recessed portion of said third wire mesh has a third depth in order to provide a third air gap between said recessed portion of said second wire mesh and said recessed portion of said third wire mesh.

15. An arc chute assembly for an electrical switching apparatus including a housing and a pair of separable contacts enclosed by said housing, said separable contacts being structured to trip open, an arc and ionized gases being generated in response to said separable contacts tripping open, said arc chute assembly comprising:

first and second opposing sidewalls;

a plurality of arc plates disposed between said first and second opposing sidewalls, said arc plates having first ends structured to be disposed proximate said separable contacts in order to attract said arc, and second ends disposed distal from the first ends for discharging said ionized gases; and an arc baffle comprising:

a first baffle member disposed at or about the second ends of said arc plates of said arc chute assembly and including a generally planar discharge portion having a periphery and a plurality of first venting holes, and an elongated spacer portion protruding outwardly from the periphery, a second baffle member including a generally planar discharge portion having a periphery and a plurality of second venting holes, and an elongated spacer portion protruding outwardly from the periphery of said second baffle member, said second baffle member being coupled to and disposed opposite from said first baffle member to form an air gap therebetween, and a filter assembly disposed at or about said second baffle member and including a number of filter elements, and a baffle mount securing said arc baffle to said arc chute assembly, wherein said first venting holes of said first baffle member are offset with respect to said second venting holes of said second baffle member and are structured to induce turbulent flow of said ionized gases being discharged from the second end of said arc chute assembly, wherein said filter elements of said filter assembly filter said turbulent flow, and wherein the elongated spacer portion of said first baffle member engages the generally planar discharge portion of said second baffle member, and the elongated spacer portion of said second baffle member engages the generally planar discharge portion of said first baffle member, thereby substantially enclosing said air gap.

16. An arc chute assembly for an electrical switching apparatus including a housing and a pair of separable contacts enclosed by said housing, said separable contacts being structured to trip open, an arc and ionized gases being generated in response to said separable contacts tripping open, said arc chute assembly comprising:

first and second opposing sidewalls;

a plurality of arc plates disposed between said first and second opposing sidewalls, said arc plates having first ends structured to be disposed proximate said separable contacts in order to attract said arc, and second ends disposed distal from the first ends for discharging said ionized gases; and an arc baffle comprising:

a first baffle member disposed at or about the second ends of said arc plates of said arc chute assembly and including a plurality of first venting holes, a second baffle member including a plurality of second venting holes and being coupled to and disposed opposite from said first baffle member, and a filter assembly disposed at or about said second baffle member and including a number of filter elements, and a baffle mount securing said arc baffle to said arc chute assembly, wherein said first venting holes of said first baffle member are offset with respect to said second venting holes of said second baffle member and are structured to induce turbulent flow of said ionized gases being discharged from the second end of said arc chute assembly, wherein said filter elements of said filter assembly filter said turbulent flow, and wherein said first baffle member is a first molded member comprising at least one first recess and at least one first protrusion; wherein said second baffle member is a second molded member comprising at least one second recess and at least one second protrusion; and wherein said first molded member and said second molded member are substantially the same in order that each of said at least one first protrusion of said first molded member is disposed within a corresponding one of said at least one second recess of said second molded member, and each of said at least one second protrusion of said second molded member is disposed within a corresponding one of said at least one first recess of said first molded member.

17. The arc chute assembly of claim 16 wherein each of said first molded member and said second molded member further comprise a generally planar portion and a spacer portion protruding from said generally planar portion; wherein said first venting holes and said second venting holes are disposed in said generally planar portion of said first molded member and said generally planar portion of said second molded member, respectively; wherein said spacer portion of said first molded member engages said generally planar portion of said second molded member, and said spacer portion of said second molded member engages said generally planar portion of said first molded member, in order that said generally planar portion of said first molded member and said generally planar portion of said second molded member are spaced apart from one another to provide an air gap therebetween; and wherein said air gap is structured to further cool and dissipate said ionized gases.

18. The arc chute assembly of claim 15 wherein said filter assembly is structured to permit said ionized gases to flow therethrough; wherein said filter elements of said filter assembly comprise a plurality of mesh members; wherein each of said mesh members has a plurality of apertures; and wherein said mesh members are layered in order to control the flow of said ionized gases through said apertures.

19. The arc chute assembly of claim 18 wherein each of said mesh members comprises a wire mesh including a flange portion and a recessed portion; wherein said recessed portion of a first wire mesh of said mesh members is disposed within and generally conforms to said recessed portion of at least a second wire mesh of said mesh members; and wherein said flange portion of at least said first wire mesh is disposed at or about said second baffle member in order that said recessed portion of said first wire mesh and said recessed portion of said at least a second wire mesh is spaced from at least one of: said recessed portion of at least one other wire mesh of said mesh members, and said second baffle member, thereby providing at least one air gap for further cooling and dissipating said ionized gases.

20. The arc chute assembly of claim 15 wherein said baffle mount comprises a generally planar member including at least one opening for discharging said ionized gases and a fastening mechanism for coupling said baffle mount and said arc baffle to said arc chute assembly.

21. The arc chute assembly of claim 20 wherein said at least one opening is a plurality of third venting holes in said generally planar member of said baffle mount; and wherein said third venting holes of said generally planar member of said baffle mount are offset with respect to at least said second venting holes of said second baffle member in order to allow further turbulent mixing of said ionized gases.

22. The arc chute assembly of claim 15 wherein said first and second opposing sidewalls of said arc chute assembly each include a plurality of openings; wherein said fastening mechanism of said baffle mount comprises a plurality of tabs; wherein each of said tabs of said baffle mount is disposed within a corresponding one of said openings of said first and second sidewalls in order to couple said baffle mount and said arc baffle to said arc chute assembly at or about the second ends of said arc plates thereof; and wherein when said baffle mount is coupled to said arc chute assembly, said filter assembly is disposed between said baffle mount and said second baffle member in order that a portion of at least one of said filter elements of said filter assembly is disposed in said opening of said generally planar member of said baffle mount, and said first baffle member and said second baffle member are disposed between said filter assembly and the second ends of said arc plates of said arc chute assembly.

23. An electrical switching apparatus comprising:

a housing;

separable contacts enclosed by said housing;

an operating mechanism structured to open and close said separable contacts and to trip open said separable contacts in response to an electrical fault; and at least one arc chute assembly disposed at or about said separable contacts in order to attract and dissipate an arc which is generated by said separable contacts tripping open in response to said electrical fault and to discharge ionized gases produced as a byproduct of said arc, said at least one arc chute assembly comprising:

first and second opposing sidewalls, a plurality of arc plates disposed between said first and second opposing sidewalls, said arc plates having first ends disposed proximate said separable contacts in order to attract said arc, and second ends disposed distal from the first ends for discharging said ionized gases, and at least one arc baffle comprising:

a first baffle member disposed at or about the second ends of said arc plates of said arc chute assembly and including a generally planar discharge portion having a periphery and a plurality of first venting holes, and an elongated spacer portion protruding outwardly from the periphery, a second baffle member including a generally planar discharge portion having a periphery and a plurality of second venting holes, and an elongated spacer portion protruding outwardly from the periphery of said second baffle member, said second baffle member being coupled to and disposed opposite from said first baffle member to form an air gap therebetween, a filter assembly disposed at or about said second baffle member and including a number of filter elements, and a baffle mount securing said at least one arc baffle to said corresponding one of said at least one arc chute assembly, wherein said first venting holes of said first baffle member are offset with respect to said second venting holes of said second baffle member and are structured to induce turbulent flow of said ionized gases being discharged from the second end of said arc chute assembly, thereby cooling said ionized gases, and wherein said filter elements of said filter assembly filter said turbulent flow, thereby further cooling said ionized gases, and wherein the elongated spacer portion of said first baffle member engages the generally planar discharge portion of said second baffle member, and the elongated spacer portion of said second baffle member engages the generally planar discharge portion of said first baffle member, thereby substantially enclosing said air gap.

24. An electrical switching apparatus comprising:

a housing;

separable contacts enclosed by said housing;

an operating mechanism structured to open and close said separable contacts and to trip open said separable contacts in response to an electrical fault; and at least one arc chute assembly disposed at or about said separable contacts in order to attract and dissipate an arc which is generated by said separable contacts tripping open in response to said electrical fault and to discharge ionized gases produced as a byproduct of said arc, said at least one arc chute assembly comprising:

first and second opposing sidewalls, a plurality of arc plates disposed between said first and second opposing sidewalls, said arc plates having first ends disposed proximate said separable contacts in order to attract said arc, and second ends disposed distal from the first ends for discharging said ionized gases, and at least one arc baffle comprising:

a first baffle member disposed at or about the second ends of said arc plates of a corresponding one of said at least one arc chute assembly, and including a plurality of first venting holes, a second baffle member including a plurality of second venting holes and being coupled to and disposed opposite from said first baffle member, a filter assembly disposed at or about said second baffle member and including a number of filter elements, and a baffle mount securing said at least one arc baffle to said corresponding one of said at least one arc chute assembly, wherein said first venting holes of said first baffle member are offset with respect to said second venting holes of said second baffle member and are structured to induce turbulent flow of said ionized gases being discharged from the second end of said arc chute assembly, thereby cooling said ionized gases, and wherein said filter elements of said filter assembly filter said turbulent flow, thereby further cooling said ionized gases, and wherein said first baffle member of said at least one arc baffle of said at least one arc chute assembly is a first molded member comprising at least one first recess and at least one first protrusion; wherein said second baffle member of said at least one arc baffle of said at least one arc chute assembly is a second molded member comprising at least one second recess and at least one second protrusion; and wherein said first molded member and said second molded member are substantially the same in order that each of said at least one first protrusion of said first molded member is disposed within a corresponding one of said at least one second recess of said second molded member, and each of said at least one second protrusion of said second molded member is disposed within a corresponding one of said at least one first recess of said first molded member.

25. The electrical switching apparatus of claim 24 wherein each of said first molded member and said second molded member further comprise a generally planar portion and a spacer portion protruding from said generally planar portion; wherein said first venting holes and said second venting holes are disposed in said generally planar portion of said first molded member and said generally planar portion of said second molded member, respectively; wherein said spacer portion of said first molded member engages said generally planar portion of said second molded member and said spacer portion of said second molded member engages said generally planar portion of said first molded member, in order that said generally planar portion of said first molded member and said generally planar portion of said second molded member are spaced apart from one another to provide an air gap therebetween; and wherein said air gap is structured to further cool and dissipate said ionized gases.

26. The electrical switching apparatus of claim 23 wherein said filter assembly of said at least one arc baffle of said at least one arc chute assembly permits said ionized gases to flow therethrough; wherein said filter elements of said filter assembly comprise a plurality of mesh members; wherein each of said mesh members is a wire mesh having a plurality of apertures, a flange portion, and a recessed portion; wherein said recessed portion of a first wire mesh of said mesh members is disposed within and generally conforms to said recessed portion of at least a second wire mesh of said mesh members; and wherein said flange portion of at least said first wire mesh is disposed at or about said second baffle member of said at least one arc baffle of said at least one arc chute assembly in order that said recessed portion of said first wire mesh and said recessed portion of said at least a second wire mesh is spaced from at least one of: said recessed portion of at least one other wire mesh of said mesh members, and said second baffle member, thereby providing at least one air gap being structured to further cool and dissipate said ionized gases.

27. The electrical switching apparatus of claim 23 wherein said baffle mount of said at least one arc baffle of said corresponding one of said at least one arc chute assembly comprises a generally planar member including an opening for discharging said ionized gases, and a fastening mechanism for coupling said baffle mount and said at least one arc baffle to said corresponding one of said at least one arc chute assembly; and wherein when said baffle mount is coupled to said corresponding one of said at least one arc chute assembly, said filter assembly of said at least one arc baffle is disposed between said baffle mount and said second baffle member of said at least one arc baffle, in order that a portion of at least one of said filter elements of said filter assembly is disposed in said opening of said generally planar member of said baffle mount, and said first baffle member and said second baffle member are disposed between said filter assembly and the second ends of said arc plates of said corresponding one of said at least one arc chute assembly.

28. The electrical switching apparatus of claim 23 wherein said electrical switching apparatus is a circuit breaker having a plurality of poles and a housing; wherein said at least one arc chute assembly comprises a plurality of arc chute assemblies for the poles of said circuit breaker; wherein said at least one arc baffle comprises a plurality of arc baffles for discharging said ionized gases from the arc chute assemblies of said circuit breaker; wherein said housing of said circuit breaker includes a plurality of exhaust openings proximate said arc chute assemblies; wherein said arc baffles are disposed at or about said exhaust openings; and wherein said baffle mount for each of said arc baffles includes a plurality of fasteners for securing each of said arc baffles at or about a corresponding one of said exhaust openings of said housing of said circuit breaker.

* * * * *